United States Patent [19]

Konopka

[11] Patent Number: 4,872,591

[45] Date of Patent: Oct. 10, 1989

[54] MEDICATION DISPENSER

[76] Inventor: Richard O. Konopka, 5695 Janet Blvd., Solon, Ohio 44139

[21] Appl. No.: 122,794

[22] Filed: Nov. 19, 1987

[51] Int. Cl.[4] ..... B65D 83/04

[52] U.S. Cl. ..... 221/3; 221/15; 221/129; 221/243

[58] Field of Search ..... 221/2, 3, 5, 15, 129, 221/243; 453/21, 41

[56] References Cited

U.S. PATENT DOCUMENTS

| | | | |
|---|---|---|---|
| 721,971 | 3/1903 | Shafer et al. . | |
| 2,406,516 | 8/1946 | Treciokas | 221/243 X |
| 3,242,929 | 3/1966 | Adams | 453/21 X |
| 3,270,915 | 9/1966 | Auer | 221/2 |
| 3,369,697 | 2/1968 | Glucksman et al. . | |
| 3,395,829 | 8/1968 | Cogdell et al. . | |
| 3,556,342 | 1/1971 | Guarr . | |
| 3,752,359 | 8/1973 | Shaw | 221/94 X |
| 3,815,780 | 6/1974 | Bauer . | |
| 3,911,856 | 10/1975 | Ewing . | |
| 3,917,045 | 11/1975 | Williams et al. . | |
| 4,207,992 | 6/1980 | Brown . | |
| 4,223,801 | 9/1980 | Carlson . | |
| 4,310,103 | 1/1982 | Reilly, Jr. et al. . | |
| 4,572,403 | 2/1986 | Benaroya | 221/3 |
| 4,573,606 | 3/1986 | Lewis et al. | 221/15 X |
| 4,660,991 | 4/1987 | Simon . | |
| 4,674,651 | 6/1987 | Scidmore et al. . | |

*Primary Examiner*—F. J. Bartuska

*Attorney, Agent, or Firm*—Weston, Hurd, Fallon, Paisley & Howley

[57] ABSTRACT

A medical dispenser includes a portable housing having a plurality of cannister-containing magazines disposed side-by-side. The cannisters are adapted to be loaded with medicines that are to be taken at different intervals. The cannisters are discharged from the magazines one at a time, the frequency of discharge being dependent upon which magazine the cannisters occupy. The cannisters are ejected from the magazine by means of a motor-driven feed slide. Dispensing operations are controlled by a motor-driven cam shaft that is operatively connected to the feed slide. The dispenser includes alarms and indicator lights that advise the user whenever a dispensing operation or a power failure has occurred.

19 Claims, 3 Drawing Sheets

MEDICATION DISPENSER

BACKGROUND OF THE INVENTION

1. Field of the Invention

The invention relates to medication dispensers and, more particularly, to a medication dispenser wherein a variety of different medicines can be dispensed at selected intervals to be determined by the user.

2. Description of the Prior Art

One of the problems confronting physicians is their inability to insure that patients will take a required dosage of medicine at regular, prescribed intervals. Failure to take the required dosage at the required intervals greatly diminishes the effectiveness of the medication. Conversely, taking the required dosage at more frequent intervals than prescribed can have undesirable effects. Consequently, it is of great importance that medication be taken in the required dosage at the required times in order that the benefits of the medication may be achieved.

The problem is exaggerated in the case of those who are chronically ill or elderly. These patients often are prescribed a wide variety of drugs or vitamins whose frequency and sequence of consumption may be difficult to keep in mind. Accordingly, it is desirable to have a device that will inform the patient exactly when medication is to be taken. Preferably, the device also will dispense the medicine so that any possibility of error will be eliminated.

Prior medication dispensing devices have dispensed medicine or a medicine-containing cannister upon the occurence of a given event. Sometimes the event is a predetermined one such as the passage of a certain amount of time, and sometimes the event is nothing but a mechanical input from the user. Certain devices are known in which medicine is fed by gravity from a rotary carousel. Further, upon rotational indexing of the carousel, the medicine is fed by gravity into a tray or other container. A drawback with this method of dispensing is that only one dispensing operation occurs at any given time. Accordingly, in order for different medicine to be taken at different intervals, it is necessary to carefully load the carousel so that accurate dispensing operations occur. It is easy to make mistakes with devices of this nature, and thus they are of limited usefulness.

Another type of medication dispenser feeds medicine-containing cannisters by gravity from a vertical or inclined chute. A representative device of this category of dispensers is shown in U.S. Pat. No. 3,369,697 to Glucksman et al. In the '697 patent, a vertically oriented compartment contains a plurality of medicine-containing vials. A solenoid-controlled release lever engages the lowermost vial in order to keep the vials within the compartment. Upon pivoting the lever, the lowermost vial is dropped into a dispenser mouth. A drawback of the '697 patent is that, like the "carousel" patents referred to above, the vials are dispensed one at a time. Therefore, in order to dispense varied medicines, it is necessary to carefully load and arrange each of the vials.

Other medicine-containing cannisters that are fed by gravity also are known. For example, U.S. Pat. No. 3,566,342 to Guarr and U.S. Pat. No. 3,917,045 to Williams, employ a large number of individual cannisters that are loaded into magazines or chutes, where they can be dispensed upon command. Although the devices disclosed in the '342 and the '045 patents are effective for the purposes indicated, they are suitable only for hospitals or pharmacies due to their large size and complexity. It would be impractical for devices of this nature to be made available for use by the average consumer.

Another type of dispenser dispenses medicine by gravity from a vertical chute by means of a horizontal pusher. For example, U.S. Pat. No. 3,395,829 to Cogdell et al discloses a medication dispensing means wherein pills are stacked in a vertical magazine. A feed plate is disposed beneath the magazine. The feed plate includes an opening adapted to receive the lowermost pill. Upon horizontal displacement of the plate, the lowermost pill is carried away from the bottom of the magazine and is deposited into a recess that is accessible to the user. The patent discloses an automatic timing mechanism for actuating the feed plate, as well as an alarm and a warning light to inform the user that a dispensing operation has occurred. Other devices of this general class are U.S. Pat. No. 721,971 to Shafer et al and U.S. Pat. No. 4,233,801 to Carlson.

Despite the availablility of various medication dispensers such as those referred to above, certain problems remain. These problems may be summarized by stating that there is no commercially available low cost medication dispenser that will accurately and automatically dispense different medicines at different intervals.

SUMMARY OF THE INVENTION

In response to the foregoing concerns, the present invention provides a new and improved medication dispenser that enables a variety of different medicines to be dispensed at different intervals. The dispenser is constructed so that it is very easy to load medicine accurately for proper dispensing at the required times. An important feature of the invention is that the foregoing objectives can be obtained relatively inexpensively, thereby permitting an effective medication dispenser to be available to a wide range of consumers.

The medication dispenser according to the invention includes a portable housing having a top wall and a front wall. A plurality of vertically oriented magazines are disposed within the housing. The magazines are adapted to receive a plurality of medicine-containing cannisters that are stacked atop each other. The cannisters are ejected from the bottom of the magazine one at a time by a discharge means which pushes the lowermost cannister from each magazine. A control means is provided for activating the discharge means at selected times.

In the preferred embodiment of the invention, the discharge means includes a horizontally movable block disposed adjacent each magazine, the block being engageable with the lowermost cannister in the magazine. The discharge means also includes a horizontally movable feed slide adjacent the blocks, a drive motor for moving the feed slide, a lost motion connection between the feed slide and the blocks, and a means for preventing the blocks from moving except at predetermined times. The control means preferably includes a motor-driven shaft carrying a plurality of cams, each cam being operatively connected to a selected horizontally movable block by means of a spring-loaded pawl. The cams are configured such that the blocks are released for horizontal movement at preselected times.

The medication dispenser according to the invention causes cannisters to be dispensed from each magazine at preselected intervals. Typically, one magazine would dispense cannisters once per day, another twice per day, another three times per day, another four times per day, and another six times per day. By loading medicine-containing cannisters into the appropriate magazines, the medicine will be dispensed on schedule. The use of separate magazines, each dispensing cannisters at a different time, helps to insure that the medication is dispensed accurately. The invention also includes visual and aural alarms that inform the user that a dispensing operation has occurred.

The medication dispenser according to the invention further includes an annunciator that informs the user whenever a power failure occurs. This feature of the invention assists the user in keeping up with the medication schedule, even in the event of a power failure.

The foregoing, and other features and advantages of the invention, will become apparent from a review of the following description and claims, taken together with the accompanying drawings.

DESCRIPTION OF THE PREFERRED EMBODIMENT

Figure 1:
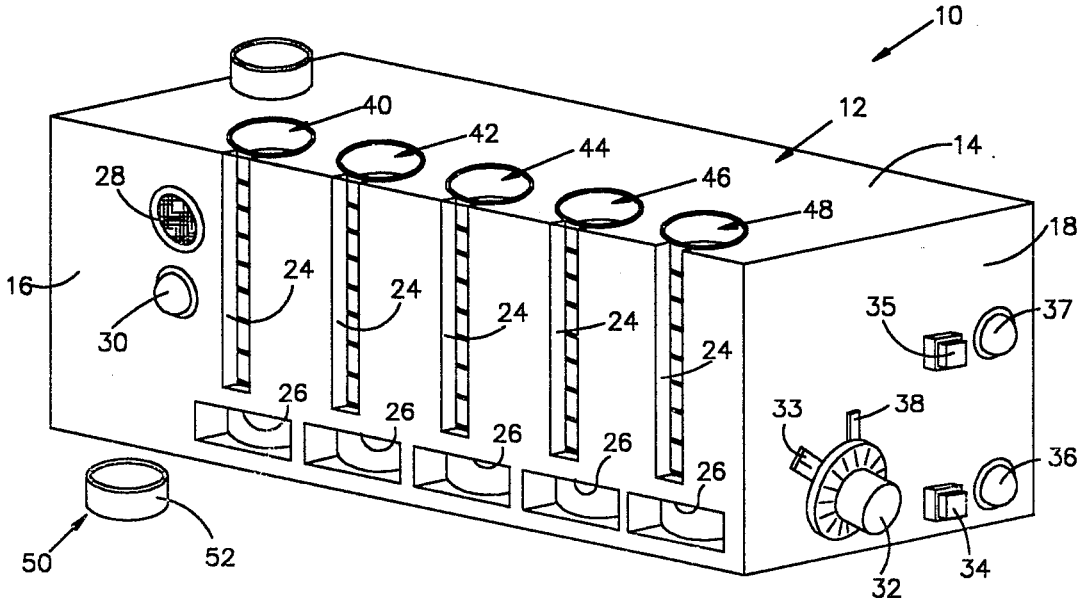
FIG. 1 is perspective view of a medication dispenser according to the invention showing a portable housing, medicine-receiving cannisters, and cannister-receiving magazines.
Figure 2:
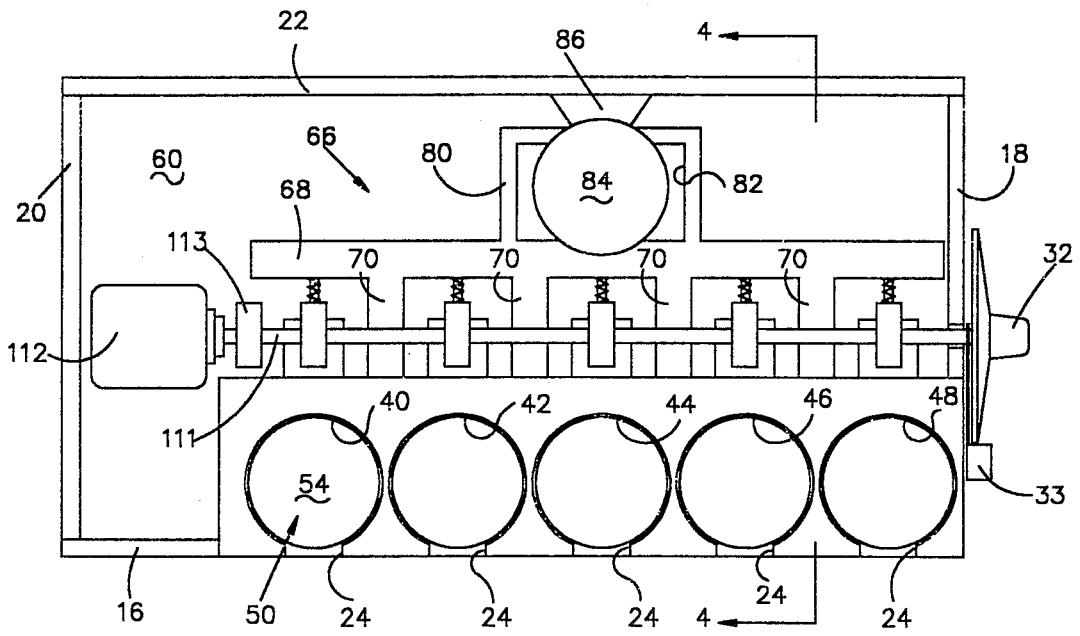
FIG. 2 is a schematic plan view of the dispenser of FIG. 1.
Figure 4:
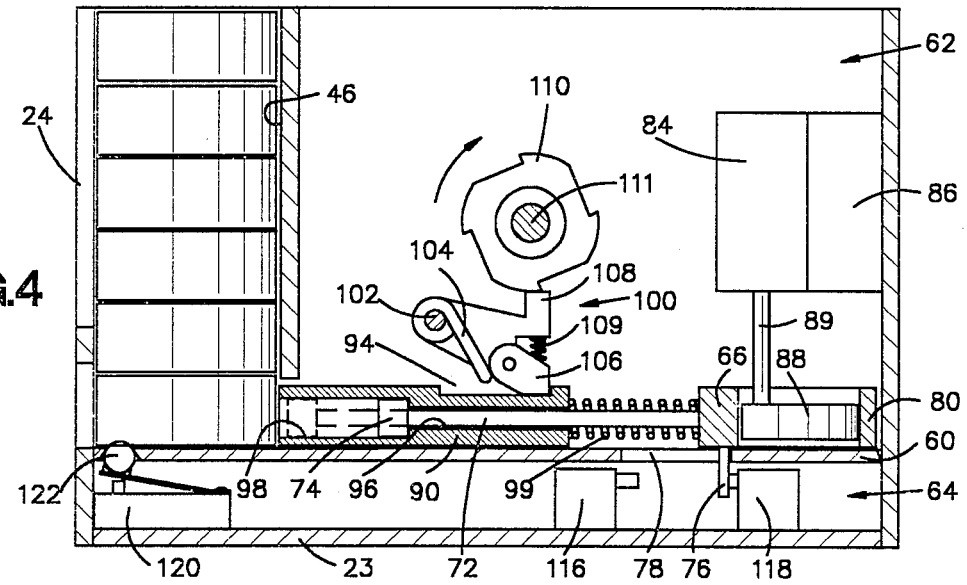
FIG. 4 is a cross-sectional view of the dispenser according to the invention taken along a plane indicated by line 4—4 in FIG. 2 and showing a dispenser means in a non-dispensing position.
Figure 5:
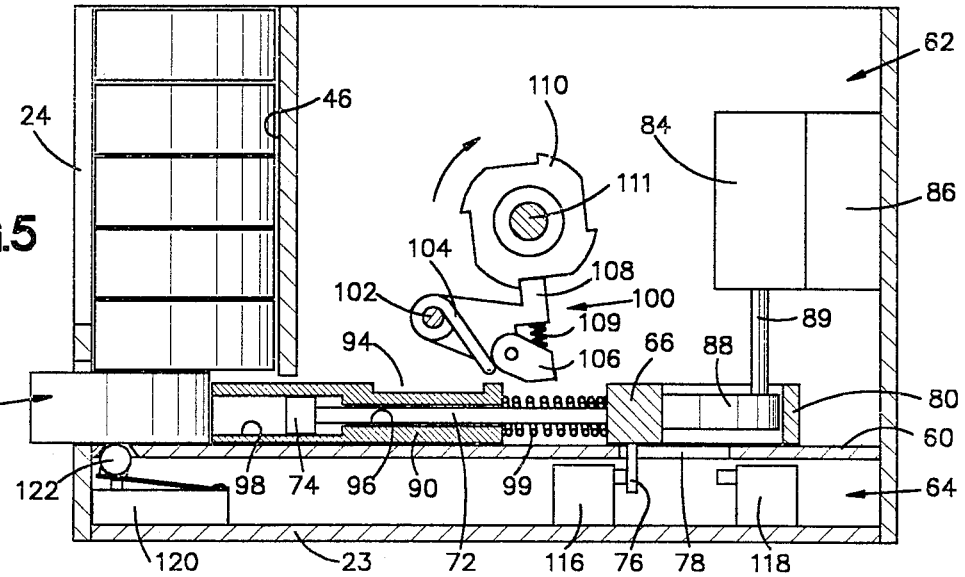
FIG. 5 is a view similar to FIG. 4 showing the dispensing means of FIG. 4 in a dispensing position.

Referring to FIG. 1, a medication dispenser according to the invention is indicated generally by the reference numeral 10. The dispenser 10 includes a housing 12 having a top wall 14, a front wall 16, side walls 18, 20, a rear wall 22, and a bottom wall 23 (FIGS. 4 and 5). The front wall 16 includes a plurality of vertically extending slots 24. Openings 26 are formed in the front wall 16 immediately below the slots 24. An aural annunciator 28 opens through the front wall 16, as does an indicator light 30. A control knob 32, reset lever 33, push buttons 34, 35, and indicator lights 36, 37 project from the side wall 18. The control knob 32 is provided with indicia that form an easily readable clock face. The wall 18 includes a marker 38 that indicates a starting point for the control knob 32.

Vertically oriented magazines 40, 42, 44, 46, 48 are disposed within the housing 12 and are accessible through the slots 24. The magazines 40, 42, 44, 46, 48 each have upper and lower ends, with an entrance opening at the upper end extending through the top wall 14 and a discharge opening at the lower end adjacent the openings 26. Disk-like cannisters 50 are adapted to be stacked atop each other within the magazines 40, 42, 44, 46, 48. Each of the cannisters 50 includes an upstanding, cylindrical side wall 52 and a flat bottom wall 54. In preferred practice, the cannisters 50 are about 0.5 inch high and have an inner diameter of about 1.6 inches, thereby enabling a quantity of tablets or capsules to be contained within a given cannister 50. By being stacked atop each other, the cannisters advance downwardly through the magazines by gravity, where they can be discharged horizontally through the openings 26.

Referring particularly to FIGS. 4 and 5, the housing 12 includes a false floor 60 dividing the housing 12 into upper and lower chambers 62, 64. A feed slide 66 is disposed in the upper chamber 62 atop the floor 60. The feed slide 66 includes a laterally extending beam 68 from which guide bars 70 project. A plurality of rods 72 are secured to the beam 68 and are disposed parallel to the guide bars 70. The guide bars 70 and the rods 72 alternate across the face of the beam 68. Each of the rods 72 includes a large end 74 for a purpose to be described. A lug 76 extends downwardly from the underside of the beam 68, through a slot 78 formed in the floor 60. A wall 80 is attached to the rear, center portion of the beam 68 and defines an enclosure 82.

A drive motor 84 is disposed within the chamber 62 and is secured to the rear wall 22 by means of a mounting bracket 86. A disk 88 is connected to the motor 84 by means of a shaft 89. The disk 88 is disposed within the enclosure 82. The shaft 89 is connected to the disk 88 off-center so that, upon rotation of the shaft 89, the disk 88 moves through an orbiting path.

A plurality of blocks 90 are disposed within the chamber 62 atop the floor 60. Each of the blocks 90 is positioned adjacent a selected one of the magazines 40, 42, 44, 46, 48. The openings 26 are positioned at a vertical location opposite the blocks 90 so that, upon horizontal displacement of a given block 90, the lowermost cannister 50 will be ejected through the opening 26. Each of the blocks 90 includes a concave end portion 92 adapted to engage the side wall 52 of the cannisters 50. The blocks 94 each include a lateral channel 94, a through opening 96, and a counterbored portion 98. The openings 96, 98 are sized to receive, respectively, the rods 72 and the large ends 74. A spring 99 is disposed about each of the rods 72 intermediate the beam 68 and the block 90. The rods 72, large ends 74, through openings 96, and counterbored portions 98 create a lost motion connection between the feed slide 66 and the blocks 90. The springs 99 serve to constantly bias the blocks 90 away from the feed slide 66.

A control mechanism is provided in order to eject the cannisters 50 at desired times. The control mechanism includes a plurality of pawls 100 that are mounted on a shaft 102. Springs 104 are wrapped about the shaft 102 and engage the underside of the pawls 100 so as to constantly bias the pawls 100 away from the blocks 90. The pawls 100 each include a pointed lower end portion 106 that engages the channel 94 in the block 90. The upper end of each pawl 100 includes a squared-off portion 108. The portions 106, 108 are movable relative to each other and are biased apart by a spring 109. Each of the pawls 100 engages a cam 110. The cams 110 are carried by a shaft 111. A motor 112 is secured to one end of the shaft 111. The control knob 32 and the reset lever 33 are secured to the other end of the shaft 111 and are movable relative to each other. A control cam 113 having a plurality of indents about its periphery also is carried by the shaft 111. The cam 113 engages a limit switch 114 (shown schematically in FIG. 6).

Figure 3:
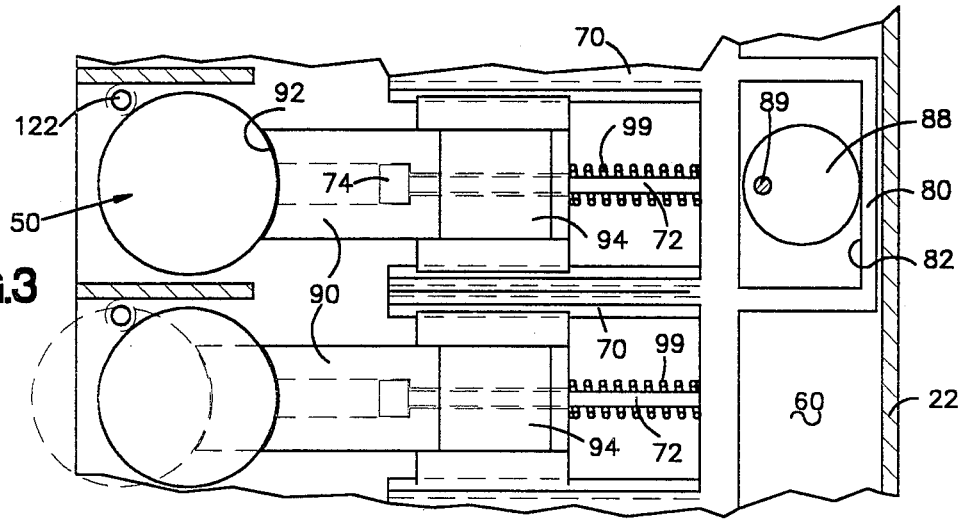
FIG. 3 is a schematic, enlarged plan view of a portion of the dispenser according to the invention showing a cannister being dispensed.

A second limit switch 116 is disposed in the chamber 64 beneath the feed slide 66, as is a third limit switch 118. The limit switches 116, 118 are positioned such that the lug 76 operatively engages them during back and forth movement of the feed slide 66. A plurality of fourth limit switches 120 also are disposed within the chamber 64 beneath the magazines 40, 42, 44, 46, 48. The limit switches 120 each include an actuating arm 122 that is engaged by the cannisters 50 as they are discharged from the magazines (see FIGS. 3–5).

Figure 6:
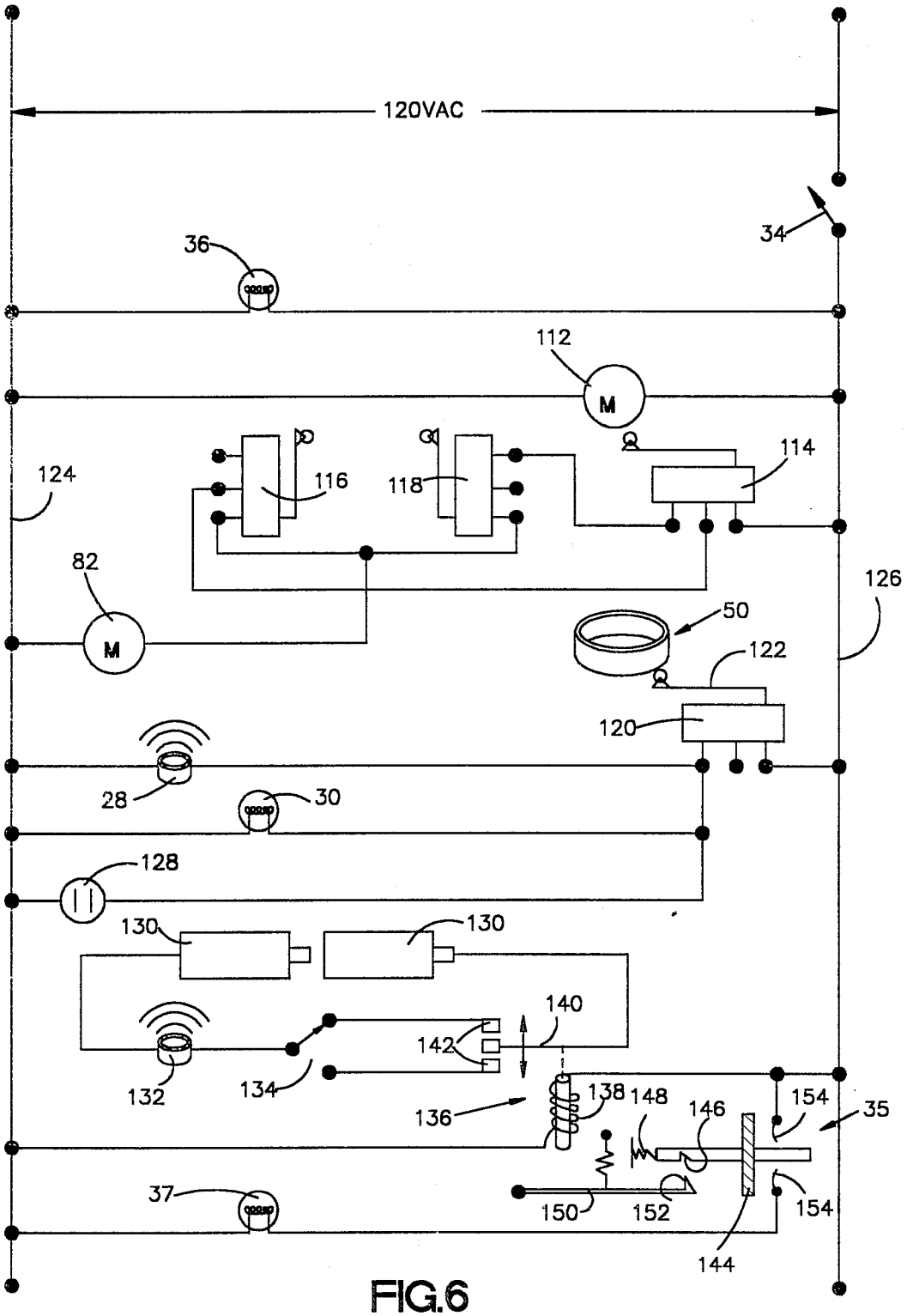
FIG. 6 is a schematic view of electrical circuitry according to the invention.

Referring particularly to FIG. 6, the various electrical components of the dispenser 10 are illustrated. In addition to the components described already, the dispenser 10 includes lead lines 124, 126 that supply 120 volt AC current to the dispenser 10. An outlet plug 128 is connected across the lead line 124 and the limit switch 120. An auxiliary annunciator system also is provided. The auxiliary annunciator system includes a plurality of batteries 130, an alarm 132, a manually-operated switch 134, and a relay 136 connected across the lead lines 124, 126. The relay 136 includes a coil 138 operatively connected to a movable contact arm 140. The contact arm 140 engages contacts 142 connected to the switch 134.

The push button 35 includes an electrically conductive portion 144 and a detent 146. A spring 148 biases the button 35 to the right as viewed in FIG. 6. A spring-biased arm 150 having a pawl 152 at one end is disposed adjacent the coil 138 and the button 35. Electrical contacts 154 are connected on either side of the button 35 and in series with the light 37.

The dispenser 10 includes other features that provide additional versatility. It is expected that the control knob 32 will be provided with large numbers indicating the 24 hours of the day so that the knob 32 can be set without difficulty. It also is possible that the knob 32 could be provided with braille indications. The outlet plug 128 enables a floor vibrator or auxilliary flasher unit to be provided for those users who may be deaf. Because the outlet 128 is connected across the limit switches 120, activation of a floor vibrator or auxilliary flasher unit would occur whenever a dispensing operation occurs.

The electrical components needed to produce the invention are quite simple and reliable, and can be acquired from a wide variety of commercial sources. For instance, the motor 84 can be any electric motor operating at 120 volts AC having a shaft rotation speed of about 7–10 revolutions per minute. Similarly, the motor 112 can be any electric motor operating at 120 volts AC that runs, or is geared to run, at one revolution per 24 hours. The various mechanical components of the dispenser 10, such as the pawls 100, either are commercially available or they can be manufactured readily using conventional machine tools. Because all of the electrical and mechanical components necessary to practice the present invention can be purchased or fabricated readily by those skilled in the art, no further discussion concerning the components is necessary.

OPERATION

In order to operate the dispenser 10, the following steps are taken:

1. After the dispenser 10 has been plugged into a source of 120 volts alternating current, the relay 136 will be activated. The coil 138 will cause the contact arm 140 to be moved to the upper contact 142 as shown in FIG. 6, thereby causing the alarm 132 to be sounded. The user then must move the switch 134 to the lowermost position shown in FIG. 6 so as to disable the alarm 132.

2. If power should be interrupted to the dispenser 10 for some reason, the coil 138 will be de-energized, thus permitting the contact arm 140 to engage the lowermost contact 142 as shown in FIG. 6. This will complete a circuit from the batteries 130 through the alarm 132, thereby alerting the user that a power failure has occurred. The user then must reset the manual switch 134 to that position shown in FIG. 6.

3. Deenergization of the coil 138 also causes the arm 150 to be displaced, thereby disengaging the pawl 152 and the detent 146. In turn, the bottom 35 will be moved to the right as viewed in FIG. 6 until electrical contact between the portion 144 and the contacts 154 occurs. The light 37 thus will be illuminated (if power has been restored) to provide a visual notice to the user that a power failure has occurred. The user must reset the button 35 in order to extinguish the light 37.

4. The reset lever 33 is rotated relative to the control knob 32 until the lever 33 is opposite the time of day at which the user desires the cannisters 50 to be dispensed from the openings 26 at the same time. The time of day selected by the user by rotating the lever 33 marks the beginning of dispensing operations.

5. The user rotates the control knob 32, and with it the lever 33, until the present time of day is opposite the marker 38 on the side wall 18.

6. As previously noted, the motor 112 is geared such that it, as well as the cams 110 and the control cam 113, rotate once every 24 hours. The control cam 113 has 12 detents equally spaced about its periphery, and thus the limit switch 114 will be activated every two hours.

7. Upon the activation of limit switch 114, electrical current will be supplied to the drive motor 84. The disk 88 will be rotated within the enclosure 82, thereby advancing the feed slide 66 toward the front wall 16. Depending upon the position of the cams 110, the pawls 100 either will engage the channels 94 in the blocks 90, or they will not. If the channels 94 are engaged, the blocks 90 will be restrained from movement and the springs 99 will be compressed. If the channels 94 are not restrained, the springs 99 will push the blocks 90 toward the front wall 16. Eventually, the concave portions 92 will push the cannisters 50 through the openings 26. The lost motion connection provided by the particular construction of the rods 96 and the blocks 90 permits the feed slide 66 to be cycled forwardly without damaging the blocks 90 that are restrained from movement.

8.As a cannister 50 is ejected from the opening 26, it displaces the arm 122 of one of the limit switches 120. The limit switch 120 then causes the alarm 28 and the light 30 to be activated so as to inform the user that a dispensing operation has occurred.

9. As the feed slide 66 attains its cannister-ejecting position, the limit switch 116 is activated by the lug 76. The limit switch 116 causes the drive motor 84 to be deactivated.

10. The feed slide 66 remains in its cannister-ejecting position for a short time until the control cam 113 again trips the limit switch 114, causing the motor 84 to be activated again. The feed slide 66 is retracted.

11. When the feed slide 66 attains its fully retracted position, the lug 76 trips the limit switch 118. In turn, the limit switch 118 causes the drive motor 84 to be deactivated. The drive motor 84 will be deactivated for about two hours, until the control cam 113 trips the limit switch 114 again.

The cams 110 are positioned relative to the control cam 113 such that the pawls 100 disengage the channels 94 shortly before the feed slide 66 commences its back-and-forth excursion. The contours of the cams 110 control the number of times that the pawls 100 can be released during a given revolution of the shaft 111 (which rotates once every 24 hours due to its connection to the motor 112). As illustrated, the cam 110 associated with the magazine 40 has one indent, thereby permitting cannisters 50 to be ejected from the magazine 40 once every 24 hours. The cam 110 associated with the magazine 42 has two indentations spaced equally about the periphery of the cam 110, thereby permitting cannisters 50 to be ejected from the magazine 42 twice a day, 12 hours apart. Similarly, the cams associated with the magazines 44, 46, 48 are configured such that cannisters 50 are dispensed every eight hours, every six hours, and every four hours, respectively.

If the user inadvertently should rotate the knob 32 while a dispensing operation is being conducted, there is a possibility that the cams 110 could force the pawls 100 downwardly. The pawls 100 or the blocks 90 could be damaged upon retraction of the feed slide 66. The springs 109 prevent such damage by permitting the portions 106, 108 to be compressed, if necessary. After the blocks 90 have passed the pawls 100 and reattained that position shown in FIG. 4, the springs 109 will continue to urge the portion 106 into contact with the channels 94.

By using the medication dispenser according to the invention, the user can dispense a wide variety of medicines at different intervals throughout the day. Importantly, the medicine can be dispensed accurately so that proper dosages are taken at the proper times. This is brought about by providing separate magazines that can be loaded with individual cannisters. Because the magazines in practice will be identified clearly with indicia indicating the rate of cannister discharge, the user can load each cannister 50 with whatever medicines need to be taken at a given frequency. Because the magazines will be clearly identified, and because the user will not have to intermingle cannisters containing different types of medicine, accurate dispensing operations will be possible without difficulty. The user can easily confirm that dispensing operations are occurring properly by looking through the slots 24 and noting how many of the cannisters 50 remain in the magazines. Further, the various annunciators included as part of the dispenser 10 insure that the user always will be notified that a dispensing operation has occurred. Yet additionally, the light 37 and the alarm 132 prevent the user from failing to take medication when required in the event a power failure should occur.

Although the invention has been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. A medication dispenser, comprising:

a plurality of cannisters within which medicine to be dispensed can be placed;

a portable housing having a top wall and a front wall;

a plurality of vertically oriented magazines disposed within the housing, the magazines adapted to receive cannisters stacked atop each other, the magazines having upper and lower ends, each magazine having an entrance opening adjacent its upper end through which cannisters can be inserted into the magazine and a discharge opening adjacent its lower end through which the lowermost cannister can be ejected from the magazine;

discharge means disposed within the housing for pushing individual cannisters through the discharge openings of selected magazines, the discharge means being movable between a cannister-ejecting position and a retracted position, the discharge means including a horizontally movable block disposed adjacent each magazine, the block being engageable with the lowermost cannister in the magazine, a horizontally movable feed slide disposed adjacent the blocks, a drive motor for moving the feed slide, a lost motion connection between the feed slide and the blocks, and means for preventing the blocks from moving except at predetermined times; and control means disposed within the housing for activating the discharge means at selected times.

2. The dispenser of claim 1, wherein the entrance openings to the magazines open through the top of the housing, and the discharge openings for the magazines open through the front wall of the housing.

3. The dispenser of claim 1, wherein the magazines are disposed side-by-side.

4. The dispenser of claim 2, wherein each magazine includes a vertical slot opening through the front wall of the housing.

5. The dispenser of claim 1, wherein the means for preventing the blocks from moving is in the form of a plurality of pawls, each pawl being engageable with a detent on a selected block.

6. The dispenser of claim 5, further including a cam engageable with each pawl, the cam being configured such that the pawl is moved to a slide-release position only during selected times, and is in a slide-locked position at other times.

7. The dispenser of claim 1, wherein the control means includes a motor-driven shaft, the shaft carrying a plurality of cams, each cam being operatively connected to a selected discharge means.

8. The dispenser of claim 7, further including:

a control cam on the motor-driven shaft;

a first limit switch engaged with the control cam, the first limit switch being activated at preselected intervals determined by the shape of the control cam;

a drive motor included as part of the discharge means; and an electrical connection between the first limit switch and the discharge means, the electrical connection causing the discharge means to be activated whenever the first limit switch is activated.

9. The dispenser of claim 8, further including:

a second limit switch engaged by the discharge means whenever the discharge means has attained a cannister-ejecting position; and an electrical connection between the second limit switch and the drive motor, the second limit switch causing the drive motor to be stopped whenever the second limit switch is activated.

10. The dispenser of claim 9, further including:

a third limit switch engaged by the discharge means whenever the discharge means is in a retracted position; and an electrical connection between the third limit switch and the drive motor, the third limit switch causing the drive motor to be stopped whenever the third limit switch is activated.

11. The dispenser of claim 1, further including a first annunciator for announcing the dispensing of a cannister.

12. The dispenser of claim 11, further including a fourth limit switch engageable with a cannister being dispensed, the limit switch being electrically connected to the annunciator so as to activate the annunciator upon the dispensing of a cannister.

13. The dispenser of claim 11, further including a second annunciator for announcing an interruption in electrical power to the dispenser.

14. The dispenser of claim 1, further including a clock timer, the clock timer activating the control means at a preselected time.

15. A medication dispenser, comprising:

a plurality of cannisters within which medicine to be dispensed can be placed;

a portable housing having a top wall and a front wall;

a plurality of vertically oriented magazines within which cannisters can be stacked atop each other, the magazines being disposed within the housing and having upper and lower ends, each magazine having an entrance opening adjacent its upper end extending through the top wall of the housing through which cannisters can be inserted into the magazine and a discharge opening adjacent its lower end opening through the front wall of the housing through which the lowermost cannister can be ejected from the magazine;

discharge means for pushing individual cannisters through the discharge opening of selected magazines, the discharge means including a horizontally movable block adjacent each magazine, the block being engageable with the lowermost cannister in the magazine, a horizontally movable feed slide disposed adjacent the blocks, a drive motor for the feed slide, a lost motion connection between the feed slide and the blocks, and a means for preventing the blocks from moving except at predetermined times; and control means for activating the discharge means at selected times, the control means including a motor-driven shaft having a plurality of cams secured thereto, a plurality of pawls, each pawl being in contact with one of the cams on the motor-driven shaft and a detent included as part of one of the blocks, whereby, upon activation of the motor-driven shaft, the cams will selectively activate the pawls so as to release the blocks, thereby permitting the blocks to be cycled through a dispensing operation upon activation of the feed slide drive motor.

16. A medication dispenser, comprising:

a plurality of cannisters within which medicine to be dispensed can be placed;

a portable housing having a top wall and a front wall;

a plurality of vertically oriented magazines disposed within the housing, the magazines adapted to receive cannisters stacked atop each other, the magazines having upper and lower ends, each magazine having an entrance opening adjacent its upper end through which cannisters can be inserted into the magazine and a discharge opening adjacent its lower end through which the lowermost cannister can be ejected from the magazine;

discharge means disposed within the housing for pushing individual cannisters through the discharge openings of selected magazines, the discharge means being movable between a cannister-ejecting position and a retracted position, the discharge means including a horizontally movable block disposed adjacent each magazine, the block being engagable with the lowermost cannister in the magazine, the discharge means further including:

a horizontally movable feed slide disposed adjacent the blocks;

a drive motor for moving the feed slide;

a lost motion connection between the feed slide and the blocks, the lost motion connection including a through opening in each block, the opening having a counterbored portion located at that end of the block adjacent the cannisters, a plurality of rods rigidly connected to the feed slide and extending into the through opening in each block, each rod having a large end disposed within the counterbored portion of the through opening, and a spring disposed about each rod intermediate the block and the feed slide; and means for preventing the blocks from moving except at predetermined times; and control means disposed within the housing for activating the discharge means at selected times.

17. The dispenser of claim 16, wherein the means for preventing the blocks from moving is in the form of a plurality of pawls, each pawl being engagable with a detent on a selected block.

18. The dispenser of claim 17, further including a cam engagable with each pawl, the cam being configured such that he pawl is moved to a slide-release position only during selected times, and is in a slide-locked position at other times.

19. The dispenser of claim 16, wherein the control means includes a motor-driven shaft, the shaft carrying a plurality of cams, each cam being operatively connected to a selected discharge means.

* * * * *